US009740223B1

(12) United States Patent
Wang et al.

(10) Patent No.: US 9,740,223 B1
(45) Date of Patent: Aug. 22, 2017

(54) REGULATOR

(71) Applicant: Realtek Semiconductor Corporation, Hsinchu (TW)

(72) Inventors: Shih-Wei Wang, Hualien County (TW); Chih-Chien Chang, Taipei (TW); Hsiang-An Yang, New Taipei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 15/201,614

(22) Filed: Jul. 4, 2016

(30) Foreign Application Priority Data

Mar. 31, 2016 (TW) ..... 105110335 A

(51) Int. Cl.
*G05F 1/565* (2006.01)
*G05F 1/56* (2006.01)
*G05F 1/575* (2006.01)

(52) U.S. Cl.
CPC ..... *G05F 1/56* (2013.01)

(58) Field of Classification Search
CPC . G05F 1/46; G05F 1/461; G05F 1/468; G05F 1/56; G05F 1/565; G05F 1/575
See application file for complete search history.

(56) References Cited

U.S. PATENT DOCUMENTS 5,548,205 A * 8/1996 Monticelli ..... G05F 1/565 323/274
6,465,994 B1 * 10/2002 Xi ..... G05F 1/575 323/274
6,917,187 B2 * 7/2005 Okubo ..... G05F 1/569 323/275
7,170,352 B1 * 1/2007 Caldwell ..... H03F 3/217 323/273
8,098,057 B2 * 1/2012 Morino ..... G05F 1/56 323/269
8,716,993 B2 * 5/2014 Kadanka ..... G05F 1/56 323/274
8,779,748 B2 * 7/2014 Gotoh ..... H02M 3/156 323/242
2013/0113447 A1 5/2013 Kadanka
2014/0266105 A1 * 9/2014 Li ..... G05F 1/565 323/280
2015/0293547 A1 * 10/2015 Tanaka ..... G05F 1/561 323/273

OTHER PUBLICATIONS

Ka Nang Leung et al., "A Capacitor-Free CMOS Low-Dropout Regulator With Damping-Factor-Control Frequency Compensation," IEEE Journal of Solid-State Circuits, vol. 38, No. 10, Oct. 2003.

* cited by examiner

*Primary Examiner* — Gary L Laxton
(74) *Attorney, Agent, or Firm* — CKC & Partners Co., Ltd.

(57) ABSTRACT

A regulator includes a driver circuit, an amplifier circuit, a first current source circuit and a second current source circuit. The driver circuit is configured to receive an input voltage and provide an output voltage. The first current source circuit is configured to provide a first current to the amplifier circuit. The second current source circuit is configured to provide a second current to the amplifier circuit according to the output voltage if the output voltage deviates from a predetermined voltage. The amplifier circuit is configured to control the driver circuit according to the output voltage and a third current, in which the third current is a sum of the first current and the second current.

16 Claims, 3 Drawing Sheets

REGULATOR

RELATED APPLICATIONS

This application claims priority to Taiwan Application Serial Number 105110335, filed Mar. 31, 2016, which is herein incorporated by reference.

BACKGROUND

Technical Field

The present disclosure relates to a regulator. More particularly, the present disclosure relates to a regulator to stabilize an output voltage.

Description of Related Art

A low dropout regulator (LDO) is widely applied in power supplies for the electronic systems, e.g., power supplies for automobile electronics, mobile phones, notebooks, and personal digital assistants (PDA). In particular, the requirements of low power consumption, high performance and high reliability in automobile electronics make design of an LDO circuit more difficult. When the power supply output of the LDO circuit switches from one mode to another, the load requirement of the LDO changes rapidly, which may result in an output voltage surge. Since a large voltage change may cause damage to the circuit, a protection mechanism for stabilizing the output voltage is very important.

SUMMARY

An aspect of the present disclosure provides a regulator. The regulator includes a driver circuit, an amplifier circuit, a first current source circuit and a second current source circuit. The driver circuit is configured to receive an input voltage and provide an output voltage. The first current source circuit is configured to provide a first current to the amplifier circuit. The second current source circuit is configured to provide a second current to the amplifier circuit according to the output voltage if the output voltage deviates from a predetermined voltage. The amplifier circuit is configured to control the driver circuit according to the output voltage and a third current, and the third current is a sum of the first current and the second current.

Another aspect of the present disclosure provides a regulator. The regulator includes a driver circuit, an amplifier circuit, a first current source circuit and a second current source circuit. The driver circuit includes an input terminal, an output terminal and a control terminal. The input terminal is configured to receive an input voltage, and the output terminal is configured to provide an output voltage. The amplifier circuit includes a first input terminal and an output terminal, and the output terminal is coupled to the control terminal of the driver circuit. The first current source circuit is coupled to the first input terminal of the amplifier circuit and configured to provide the first current to the amplifier circuit. The second current source circuit is coupled to the first input terminal of the amplifier circuit and configured to provide a second current to the amplifier circuit according to the output voltage if the output voltage deviates from a predetermined voltage. The amplifier circuit is configured to control the driver circuit according to the output voltage and a third current, and the third current is a sum of the first current and the second current.

In conclusion, the regulator of the present disclosure stabilizes the output voltage. The regulator of the present disclosure can adjust the bandwidth and the response speed of the amplifier circuit according to the deviation of the output voltage from the predetermined voltage so as to control the speed of adjusting the output voltage of the driver circuit. If the deviation is larger, the amplifier circuit increases the speed of controlling the driver circuit to adjust the output voltage to the predetermined voltage. Therefore, the regulator of the present disclosure can effectively improve the stability of the output voltage.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
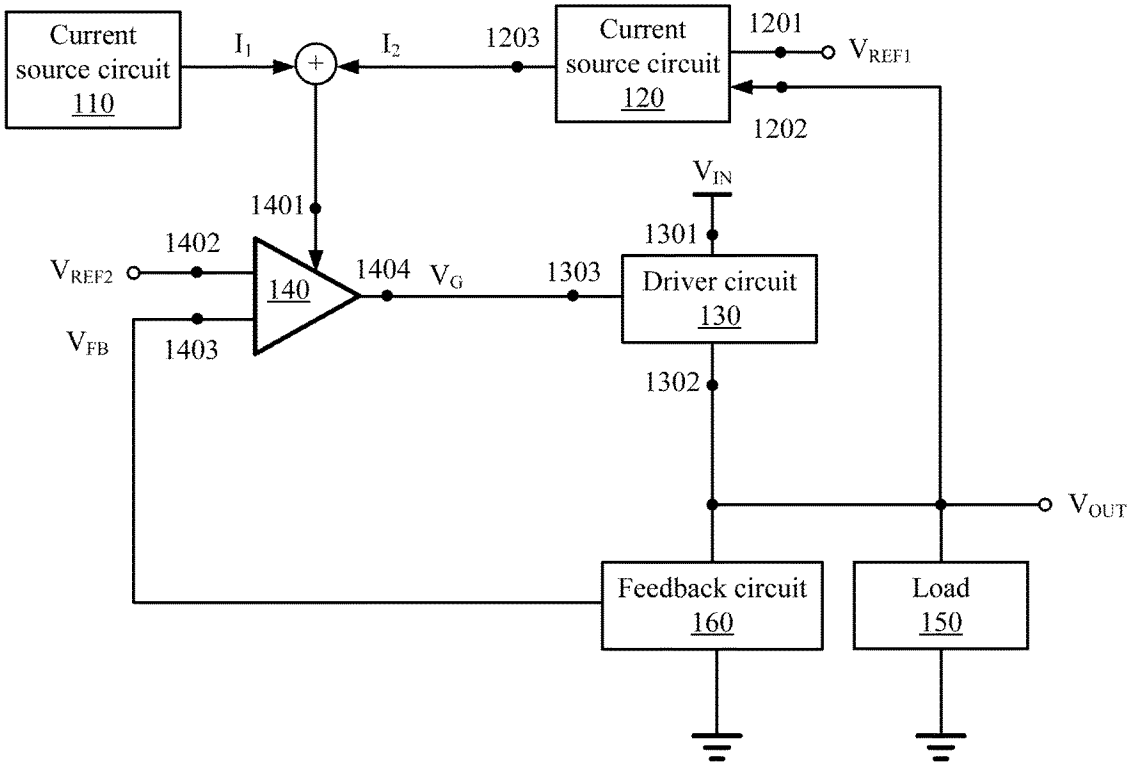
FIG. 1 is a schematic diagram of a regulator according to an embodiment of the present disclosure.

Reference is made in detail to the present embodiments of the disclosure, examples of which are illustrated in the accompanying drawings. Wherever possible, the same reference numbers are used in the drawings and the description to refer to the same or like parts.

In the following description and claims, the terms "coupled" and "connected," along with their derivatives, may be used. In particular embodiments, "connected" and "coupled" may be used to indicate that two or more elements are in direct physical or electrical contact with each other, or may also mean that two or more elements may be in indirectly electrical contact with each other. The terms "coupled" and "connected" may still be used to indicate that two or more elements cooperate or interact with each other.

Reference is made to FIG. 1. FIG. 1 is a schematic diagram of a regulator according to an embodiment of the present disclosure. The regulator may be applied to automobile electronics, a mobile phone, a notebook or a personal digital assistant (PDA), and the present disclosure is not limited in this regard.

The regulator includes a current source circuit 110, a current source circuit 120, a driver circuit 130 and an amplifier circuit 140.

The driver circuit 130 is configured to receive an input voltage $V_{IN}$ through an input terminal 1301, and provide an output voltage $V_{OUT}$ to a load 150 through an output terminal 1302.

The amplifier circuit 140 has a first input terminal 1401, a second input terminal 1402, a third input terminal 1403 and an output terminal 1404. The output terminal 1404 is coupled to a control terminal 1303 of the driver circuit 130. The amplifier circuit 140 is configured to control the driver circuit 130 according to the output voltage $V_{OUT}$. Specifically, the second input terminal 1402 of the amplifier circuit 140 is configured to receive a reference voltage $V_{REF2}$, the third input terminal 1403 of the amplifier circuit 140 is configured to receive a feedback voltage $V_{FB}$, and the feedback voltage $V_{FB}$ may be generated by a feedback circuit 160, e.g., a voltage dividing circuit, that is coupled to the output voltage $V_{OUT}$. The amplifier circuit 140 is configured to amplify a voltage difference between the feedback voltage $V_{FB}$ and the reference voltage $V_{REF2}$, and then to generate a control voltage $V_G$ to control the driver circuit 130, such that the driver circuit 130 can provide the output voltage $V_{OUT}$.

The current source circuit 110 and the current source circuit 120 are coupled to the first input terminal 1401 of the amplifier circuit 140. The current source circuit 110 is configured to provide a current $I_1$ to the first input terminal 1401 of the amplifier circuit 140, and the current source circuit 120 is configured to provide a current $I_2$ to the first input terminal 1401 of the amplifier circuit 140. In other words, the first input terminal 1401 of the amplifier circuit 140 is configured to receive a sum of the current $I_1$ and the current $I_2$. It should be noted that the current $I_1$ provided by the current source circuit 110 has a fixed current value, and the current $I_2$ provided by the current source circuit 120 is provided according to the output voltage $V_{OUT}$. Therefore, if the output voltage $V_{OUT}$ deviates from a predetermined voltage, e.g., by 1 volt, the current source circuit 120 adjusts a current value of the current $I_2$ accordingly to adjust a bandwidth and a response speed of the amplifier circuit 140, such that a speed of adjusting the output voltage by the driver circuit 130 can be controlled.

In some embodiments, the current source circuit 120 is further configured to provide the current $I_2$ to the amplifier circuit 140 according to a voltage difference $\Delta V_1$ between the output voltage $V_{OUT}$ and the reference voltage $V_{REF1}$. As shown in FIG. 1, a first input terminal 1201 of the current source circuit 120 is configured to receive the reference voltage $V_{REF1}$, a second input terminal 1202 of the current source circuit 120 is configured to receive the output voltage $V_{OUT}$, and an output terminal 1203 of the current source circuit 120 is configured to provide the current $I_2$ to the amplifier circuit 140. It should be noted that the reference voltage $V_{REF1}$ may be the predetermined voltage in the present embodiment. If the voltage difference $\Delta V_1$ is increased, the current source circuit 120 provides an increased current $I_2$ to the amplifier circuit 140. Because the bandwidth of the amplifier circuit 140 is proportional to a current received by the first input terminal 1401, the increased current $I_2$ increases the bandwidth and the response speed of the amplifier circuit 140. Therefore, the amplifier circuit 140 increases a speed of controlling the driver circuit 130 to increase or reduce the output voltage $V_{OUT}$ in order to adjust the output voltage $V_{OUT}$ to the predetermined voltage.

As mentioned above, if the output voltage $V_{OUT}$ is getting larger than the reference voltage $V_{REF1}$, the amplifier circuit 140 receives the fixed current $I_1$ and the increased current $I_2$ to increase a speed of controlling the driver circuit 130 to reduce a load current of the output terminal 1302, and the output voltage $V_{OUT}$ is therefore reduced. During the time that the output voltage $V_{OUT}$ is reduced, i.e., the time that the voltage difference $\Delta V_1$ is reduced, the current $I_2$ outputted by the current source circuit 120 to the amplifier circuit 140 is reduced. In a stable state, the output voltage $V_{OUT}$ is reduced to the reference voltage $V_{REF1}$, i.e., the predetermined voltage, the current $I_2$ is approximately zero, and the amplifier circuit 140 equivalently receives the current $I_1$ to control the driver circuit 130.

In contrast, if the output voltage $V_{OUT}$ is getting smaller than the reference voltage $V_{REF1}$, the amplifier circuit 140 receives the fixed current $I_1$ and the increased current $I_2$ to increases a speed of controlling driver circuit 130 to increase a load current of the output terminal 1302, and the output voltage $V_{OUT}$ is therefore increased. During the time that the output voltage $V_{OUT}$ is increased, i.e., the time the voltage difference $\Delta V_1$ is reduced, the current $I_2$ outputted by the current source circuit 120 to the amplifier circuit 140 is reduced. In a stable state, the output voltage $V_{OUT}$ is increased to the reference voltage $V_{REF1}$, i.e., the predetermined voltage, the current $I_2$ is approximately zero, and the amplifier circuit 140 equivalently receives the current $I_1$ to control the driver circuit 130.

In some embodiments, the reference voltage $V_{REF1}$ may be the same as or different from the reference voltage $V_{REF2}$.

As a result, if the output voltage $V_{OUT}$ deviates from the predetermined voltage, the current source circuit 120 provides an additional current $I_2$ to the amplifier circuit 140 to improve the bandwidth and the response speed of the amplifier circuit 140 so as to increase the speed of adjusting the voltage of the driver circuit 130. Therefore, the regulator of the present application can rapidly adjust an output voltage that is too high or too low to the predetermined voltage so as to improve the stability of the output voltage $V_{OUT}$.

Alternatively, in other embodiments, the reference voltage $V_{REF1}$ received by the first input terminal 1201 of the current source circuit 120 may be different from the predetermined voltage at the output terminal 1302 of the driver circuit 130, and the second input terminal 1202 may be configured to receive a feedback voltage $V_{FB}$ (not shown in FIG. 1) rather than the output voltage $V_{OUT}$. In this situation, the current source circuit 120 is further configured to provide a current $I_2$ according to a voltage difference $\Delta V_2$ between the feedback voltage $V_{FB}$ and the reference voltage $V_{REF1}$. It should be noted that the feedback voltage $V_{FB}$ is generated by the feedback circuit 160, e.g., voltage dividing circuit, according to the output voltage $V_{OUT}$ in the present embodiment. Therefore, the feedback voltage $V_{FB}$ is in a corresponding relation with the output voltage $V_{OUT}$. In a stable state, the feedback voltage $V_{FB}$ is approximately equal to the reference voltage $V_{REF1}$, and the output voltage $V_{OUT}$ is approximately equal to the predetermined voltage. Therefore, the corresponding relation between the reference voltage $V_{REF1}$ and the predetermined voltage may be determined by a corresponding relation between the feedback voltage $V_{FB}$ and the output voltage $V_{OUT}$. As mentioned above, if the voltage difference $\Delta V_2$ is increased, the current source circuit 120 provides the increased current $I_2$ to the amplifier circuit 140. Therefore, the amplifier circuit 140 increases a speed of controlling the driver circuit 130 to increase or reduce the output voltage $V_{OUT}$ so as to adjust the output voltage $V_{OUT}$ to the predetermined voltage.

As mentioned above, if the output voltage $V_{OUT}$ is getting larger than the predetermined voltage, and the feedback voltage $V_{FB}$ is larger than the reference voltage $V_{REF1}$, the amplifier circuit 140 receives the fixed current $I_1$ and the increased current $I_2$ to increase a speed of controlling the driver circuit 130 to reduce the load current of the output terminal 1302, and the output voltage $V_{OUT}$ is therefore reduced. During the time that the output voltage $V_{OUT}$ is reduced, i.e., the time that the feedback voltage $V_{FB}$ is reduced and that the voltage difference $\Delta V_2$ is reduced, the current $I_2$ outputted by the current source circuit 120 to the amplifier circuit 140 is reduced. In a stable state, the feedback voltage $V_{FB}$ is reduced to the reference voltage $V_{REF1}$, i.e., the output voltage $V_{OUT}$ is reduced to the predetermined voltage, the current $I_2$ is approximately zero, and the amplifier circuit 140 equivalently receives the current $I_1$ to control the driver circuit 130. In contrast, if the output voltage $V_{OUT}$ is getting smaller than the predetermined voltage and the feedback voltage $V_{FB}$ is smaller than the reference voltage $V_{REF1}$, the amplifier circuit 140 receives the fixed current $I_1$ and the increased current $I_2$ to increase a speed of controlling the driver circuit 130, so as to increase the load current of the output terminal 1302, and the output voltage $V_{OUT}$ is therefore increased. During the time that the output voltage $V_{OUT}$ is increased, i.e., the time that the feedback voltage $V_{FB}$ is increased and that the voltage difference $\Delta V_2$ is reduced, the current $I_2$ outputted by the current source circuit 120 to the amplifier circuit 140 is also reduced. In a stable state, the feedback voltage $V_{FB}$ is increased to the reference voltage $V_{REF1}$, i.e., the output voltage $V_{OUT}$ is increased to the predetermined voltage, the current $I_2$ is approximately zero, and the amplifier circuit 140 equivalently receives the current I1 to control the driver circuit 130.

Figure 2:
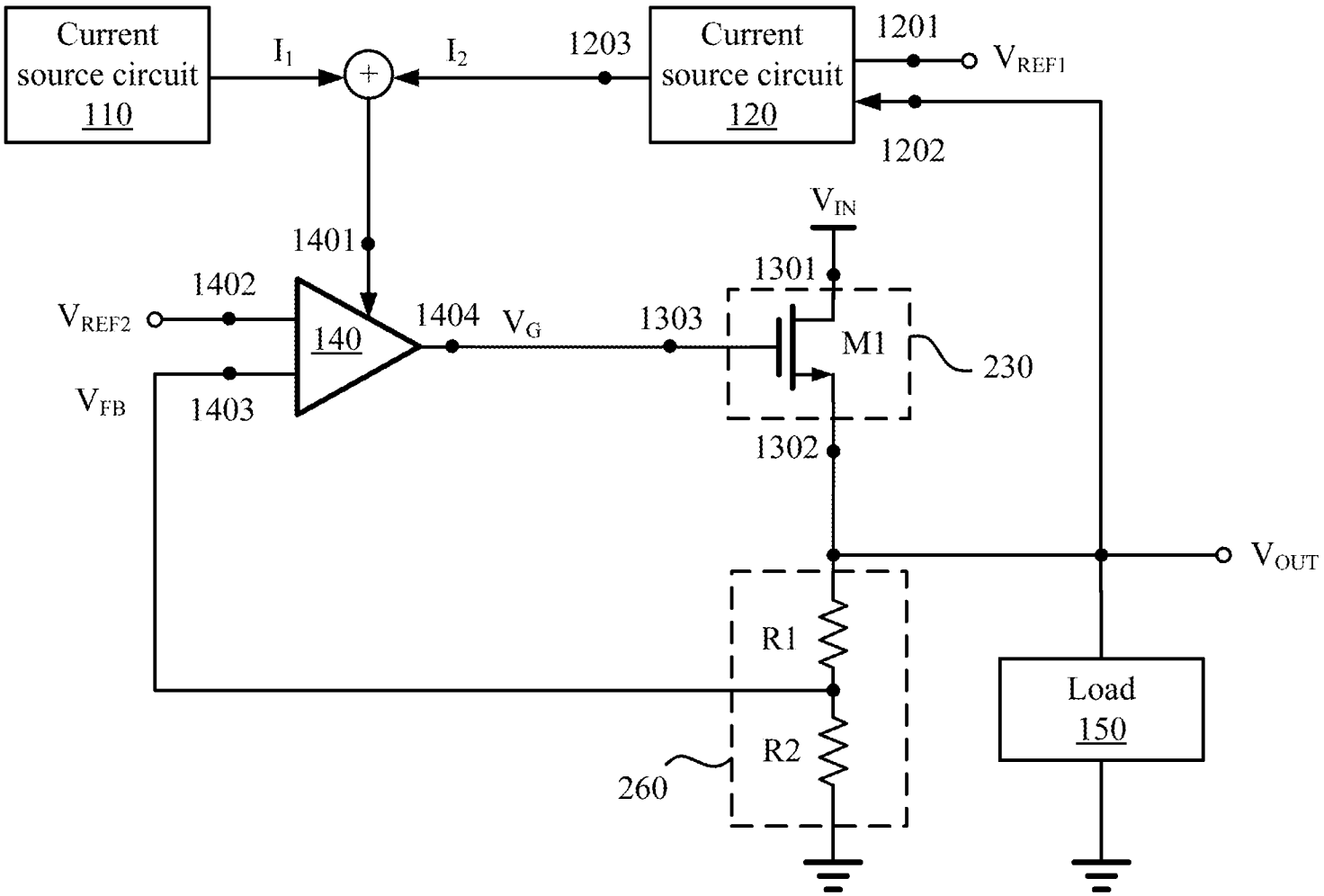
FIG. 2 is a schematic diagram of a regulator according to an embodiment of the present disclosure.

Reference is made to FIG. 2. FIG. 2 is a schematic diagram of a regulator according to an embodiment of the present disclosure. The regulator in FIG. 2 includes a current source circuit 110, a current source circuit 120 and an amplifier circuit 140 as shown in FIG. 1. The driver circuit 230 may be a transistor M1, and the feedback circuit 260 may be a voltage dividing circuit formed by resistors R1 and R2 connected in series. Therefore, the corresponding relation between the output voltage $V_{OUT}$ and the feedback voltage $V_{FB}$ may be determined by the voltage dividing circuit. As mentioned above, in an embodiment where the current source circuit 120 provides the current $I_2$ according to the voltage difference $\Delta V_1$ between the output voltage $V_{OUT}$ and the reference voltage $V_{REF1}$, in a stable state, the current $I_2$ is approximately zero, the output voltage $V_{OUT}$ is approximately the reference voltage $V_{REF1}$, i.e., the predetermined voltage. In some embodiments, in a stable state, the reference voltage $V_{REF2}$ is larger than the feedback voltage $V_{FB}$.

Figure 3:
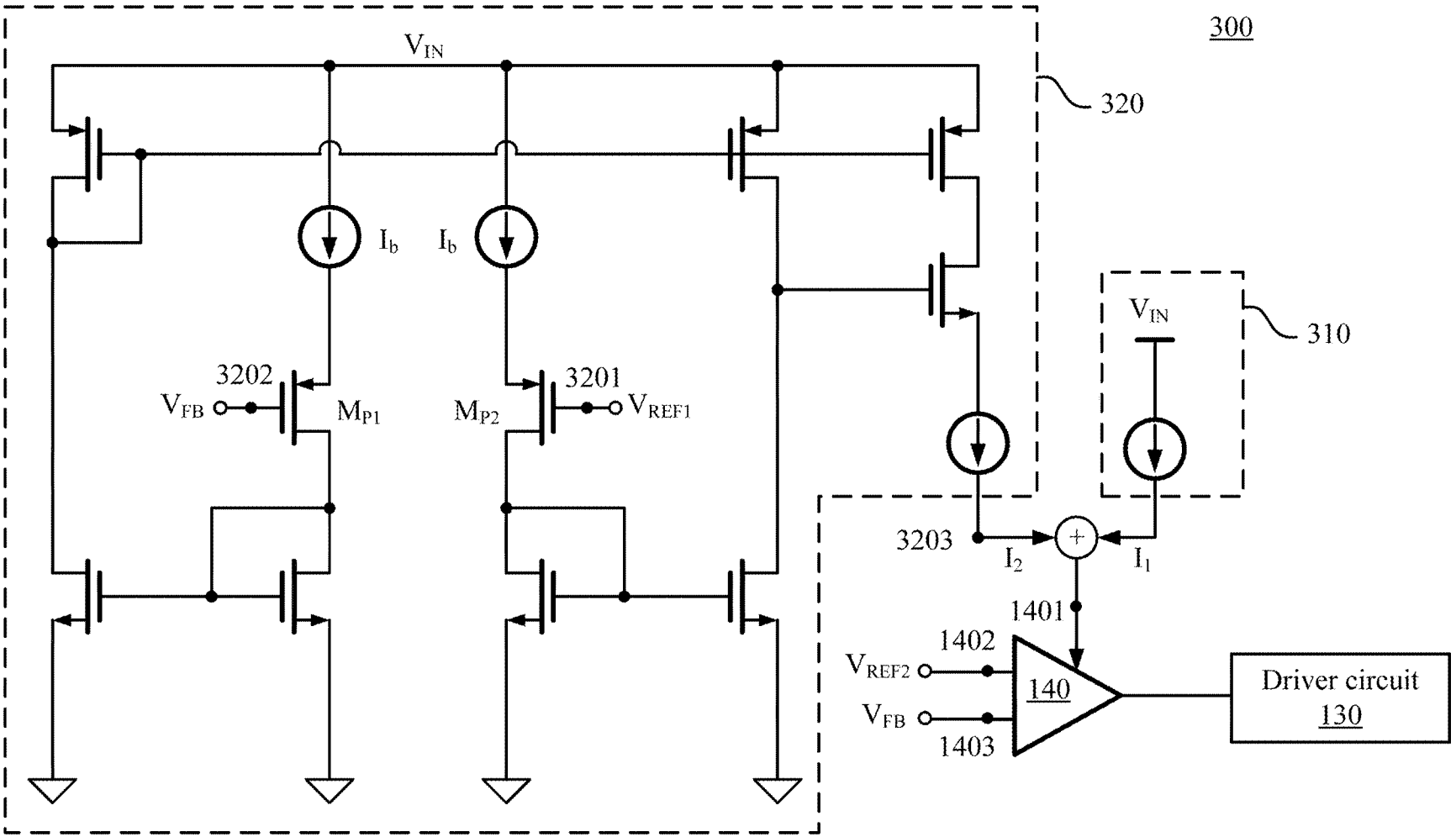
FIG. 3 is a schematic diagram of a regulator according to an embodiment of the present disclosure.

Reference is made to FIG. 3. FIG. 3 is a schematic diagram of a regulator 300 according to an embodiment of the present disclosure. The regulator 300 in FIG. 3 includes a driver circuit 130 and an amplifier circuit 140 as shown in FIG. 1. The current source circuit 310 may be a current source that provides a fixed current $I_1$, and the current source circuit 320 may be a differential amplifier circuit. A first input terminal 3201 of the current source circuit 320 is configured to receive the reference voltage $V_{REF1}$, and a second input terminal 3202 of the current source circuit 320 is configured to receive the feedback voltage $V_{FB}$ (or the output voltage $V_{OUT}$). The current source circuit 320 is configured to amplify the voltage difference $\Delta V_2$ (or the voltage difference $\Delta V_1$) between the feedback voltage $V_{FB}$ (or the output voltage $V_{OUT}$) and the reference voltage $V_{REF1}$ to provide the current $I_2$ to the amplifier circuit 140. It should be noted that transistors $M_{P1}$ and $M_{P2}$ have the same size, e.g., same channel size, and are coupled to current sources $I_b$ respectively. Therefore, if the feedback voltage $V_{FB}$ (or the output voltage $V_{OUT}$) is approximately the reference voltage $V_{REF1}$, the current I2 outputted by the current source circuit 320 is approximately zero. In the present embodiment, if the second input terminal 3202 is configured to receive the feedback voltage $V_{FB}$, the reference voltage $V_{REF2}$ is set to a voltage value that is larger than the reference voltage $V_{REF1}$.

In practice, the amplifier circuit 140 may be an error amplifier. The transistors M1, $M_{P1}$ and $M_{P2}$ may be N-type metal oxide semiconductor field effect transistors (N-MOSFETs), P-type metal oxide semiconductor field effect transistors (P-MOSFETs), bipolar junction transistors (BJTs) or other equivalent transistors, and the present disclosure is not limited in this regard.

In conclusion, the regulator 140 of the present disclosure stabilizes the output voltage. The regulator 140 of the present disclosure can adjust the bandwidth and the response speed of the amplifier circuit 140 according to the deviation of the output voltage from the predetermined voltage so as to control the speed of adjusting the output voltage of the driver circuit 130. If the deviation is larger, the amplifier circuit 140 increases the speed of controlling the driver circuit 130 to adjust the output voltage to the predetermined voltage. Therefore, the regulator of the present disclosure can effectively improve the stability of the output voltage.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A regulator, comprising:

a driver circuit, configured to receive an input voltage and provide an output voltage;

an amplifier circuit;

a first current source circuit, configured to provide a first current to the amplifier circuit; and a second current source circuit, configured to provide a second current to the amplifier circuit according to the output voltage if the output voltage deviates from a predetermined voltage;

wherein the amplifier circuit is configured to control the driver circuit according to the output voltage and a third current, the third current is a sum of the first current and the second current, and the second current source circuit is further configured to provide the second current according to a first voltage difference between the output voltage and a reference voltage, and the reference voltage is the predetermined voltage;

wherein if the first voltage difference is getting larger, the second current source circuit increases the second current so that the amplifier circuit increases a speed of controlling the driver circuit to reduce the output voltage.

2. The regulator of claim 1, wherein if the output voltage is getting larger than the reference voltage, the second current source circuit increases the second current that the amplifier circuit increases the speed of controlling the driver circuit to reduce the output voltage.

3. The regulator of claim 1, wherein if the output voltage is getting smaller than the reference voltage, the second current source circuit increases the second current so that the amplifier circuit increases the speed of controlling the driver circuit to increase the output voltage.

4. The regulator of claim 1, wherein the second current source circuit comprises:

a differential amplifier circuit, configured to amplify the first voltage difference to provide the second current.

5. The regulator of claim 1, wherein the amplifier circuit is configured to amplify a second voltage difference between a feedback voltage and the reference voltage to control the driver circuit, and the feedback voltage corresponds to the output voltage.

6. A regulator, comprising:

a driver circuit, configured to receive an input voltage and provide an output voltage;

an amplifier circuit;

a first current source circuit configured to provide a first current to the amplifier circuit; and a second current source circuit, configured to provide a second current to the amplifier circuit according to the output voltage if the output voltage deviates from a predetermined voltage;

wherein the amplifier circuit is configured to control the driver circuit according to the output voltage and a third current, the third current is a sum of the first current and the second current, and the second current source circuit is further configured to provide the second current according to a voltage difference between a feedback voltage and a reference voltage, the feedback voltage corresponds to the output voltage, and the reference voltage corresponds to the predetermined voltage, wherein if the voltage difference is getting larger, the second current source circuit increases the second current so that the am amplifier circuit increases a speed of controlling the driver circuit to reduce the output voltage.

7. The regulator of claim 6, wherein if the feedback voltage is getting larger than the reference voltage, the second current source circuit increases the second current so that the amplifier circuit increases the speed of controlling the driver circuit to reduce the output voltage.

8. The regulator of claim 6, wherein if the feedback voltage is getting smaller than the reference voltage, the second current source circuit increases the second current so that the amplifier circuit increases the speed of controlling the driver circuit to increase the output voltage.

9. The regulator of claim 6, wherein the second current source circuit comprises:

a differential amplifier circuit, configured to amplify the voltage difference to provide the second current.

10. The regulator of claim 6, wherein the amplifier circuit is configured to amplify the voltage difference between the feedback voltage and the reference voltage to control the driver circuit, and the feedback voltage corresponds to the output voltage.

11. A regulator, comprising:

a driver circuit, comprising an input terminal, an output terminal and a control terminal, wherein the input terminal is configured to receive an input voltage, and the output terminal is configured to provide an output voltage;

an amplifier circuit, comprising a first input terminal and an output terminal, wherein the output terminal is coupled to the control terminal of the driver circuit;

a first current source circuit, coupled to the first input terminal of the amplifier circuit and configured to provide a first current to the amplifier circuit; and a second current source circuit, coupled to the first input terminal of the amplifier circuit and configured to provide a second current to the amplifier circuit according to the output voltage if the output voltage deviates from a predetermined voltage;

wherein the amplifier circuit is configured to control the driver circuit according to the output voltage and a third current, the third current is a sum of the first current and the second current, and the second current source circuit is further configured to provide the second current according to a voltage difference between a feedback voltage and a reference voltage, the feedback voltage corresponds to the output voltage, and the reference voltage corresponds to the predetermined voltage, wherein if the voltage difference is getting larger, the second current source circuit increases the second current so that the amplifier circuit increases a speed of controlling the driver circuit to reduce the output voltage.

12. The regulator of claim 11, wherein the feedback voltage is the output voltage.

13. The regulator of claim 11, wherein if the feedback voltage is getting larger than the reference voltage, the second current source circuit increases the second current so that the amplifier circuit increases the speed of controlling the driver circuit to reduce the output voltage.

14. The regulator of claim 11, wherein if the feedback voltage is getting smaller than the reference voltage, the second current source circuit increases the second current so that the amplifier circuit increases the speed of controlling the driver circuit to increase the output voltage.

15. The regulator of 11, wherein the second current source circuit comprises:

a differential amplifier circuit, comprising a first input terminal a second input, terminal and an output terminal, wherein the first input terminal is configured to receive the reference voltage, the second input terminal is configured to receive the feedback voltage, and the differential amplifier circuit is configured to amplify the voltage difference to provide the second current through the output terminal.

16. The regulator of claim 11, wherein the amplifier circuit further comprises a second input terminal and a third input terminal, the second input terminal configured to receive the reference voltage, the third input terminal is configured to receive the feedback voltage, the amplifier circuit is configured to amplify the voltage difference between the feedback voltage and the reference voltage to control the driver circuit, and the feedback voltage corresponds to the output voltage.

* * * * *